US007546065B2

(12) United States Patent
Kabashima

(10) Patent No.: US 7,546,065 B2
(45) Date of Patent: Jun. 9, 2009

(54) SHEET FEEDING APPARATUS AND IMAGE FORMING APPARATUS WITH SHEET SEPARATING UNIT

(75) Inventor: Akio Kabashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 420 days.

(21) Appl. No.: 11/474,412

(22) Filed: Jun. 26, 2006

(65) Prior Publication Data

US 2007/0104509 A1 May 10, 2007

(30) Foreign Application Priority Data

Nov. 9, 2005 (JP) ..... 2005-324623

(51) Int. Cl.
*G03G 15/00* (2006.01)
*G03G 21/16* (2006.01)

(52) U.S. Cl. ..... 399/124; 399/388; 399/391

(58) Field of Classification Search ..... 399/124, 399/388, 391; 271/11, 97, 98
See application file for complete search history.

(56) References Cited

U.S. PATENT DOCUMENTS 6,015,144 A * 1/2000 Yoshii et al. ..... 271/97
6,543,759 B2 * 4/2003 Yamaguchi et al. ..... 271/98
6,629,692 B2 * 10/2003 Allner et al. ..... 271/98

FOREIGN PATENT DOCUMENTS

JP 2004-19187 1/2001

* cited by examiner

*Primary Examiner*—William J Royer
(74) *Attorney, Agent, or Firm*—Morgan, Lewis & Bockius LLP

(57) ABSTRACT

A sheet feeding apparatus includes: a body; a tray unit on which a plurality of sheets are mounted, the tray unit being provided in the body; a separating unit that separates the plurality of sheets by blowing air toward the plurality of sheets mounted on the tray unit; and a cover that is attached to the body at a position near the tray unit so as to be capable of opening and closing, the cover being provided with at least a part of the separating unit.

20 Claims, 8 Drawing Sheets

SHEET FEEDING APPARATUS AND IMAGE FORMING APPARATUS WITH SHEET SEPARATING UNIT

CROSS-REFERENCE TO RELATED APPLICATION

This application claims priority under 35 USC 119 from Japanese patent document, application No. 2005-324623, filed on Nov. 9, 2005, the disclosure of which is incorporated by reference herein.

BACKGROUND

1. Technical Field

The present invention relates to an image forming apparatus utilizing an electro-photographic system, such as a copying machine, a printer, a facsimile, a multifunction machine of these functions, and the like.

2. Related Art

In an image forming apparatus such as a printer and a copying machine, cut sheets (papers, flat papers), which can be continuously fed are generally used as recording medium on which an image is formed. For the purpose of restraining so-called multifeeding by which a plurality of sheets are fed in tight contact, when the sheets are fed out one by one from a sheet tray, copying sheets and high quality sheets to be used in the image forming apparatus are designated by respective manufacturers of the copying machines. The sheets designated by the manufacturers have relatively low surface smoothness, and adhesiveness between the sheets is weak.

However, in recent years, it has become more and more required that the sheets of various types including those having high surface smoothness are conveyed, as diversity of the recording medium increases. Particularly, with progress of coloring technique, it has been highly required to convey, in a machine of the same type, coated paper having enhanced whiteness and gloss, an OHP sheet, tracing paper and the like and further, thick paper having especially high basis weight.

SUMMARY

According to an aspect of the invention, there is provided a sheet feeding apparatus including a body; a tray unit on which a plurality of sheets are mounted, the tray unit being provided in the body; a separating unit that separates the plurality of sheets by blowing air toward the plurality of sheets mounted on the tray unit; and a cover that is attached to the body at a position near the tray unit so as to be capable of opening and closing, the cover being provided with at least a part of the separating unit.

BRIEF DESCRIPTION OF THE DRAWING

Embodiments of the present invention will be described in detail based on the following figures, wherein.

DETAILED DESCRIPTION

Figure 1:
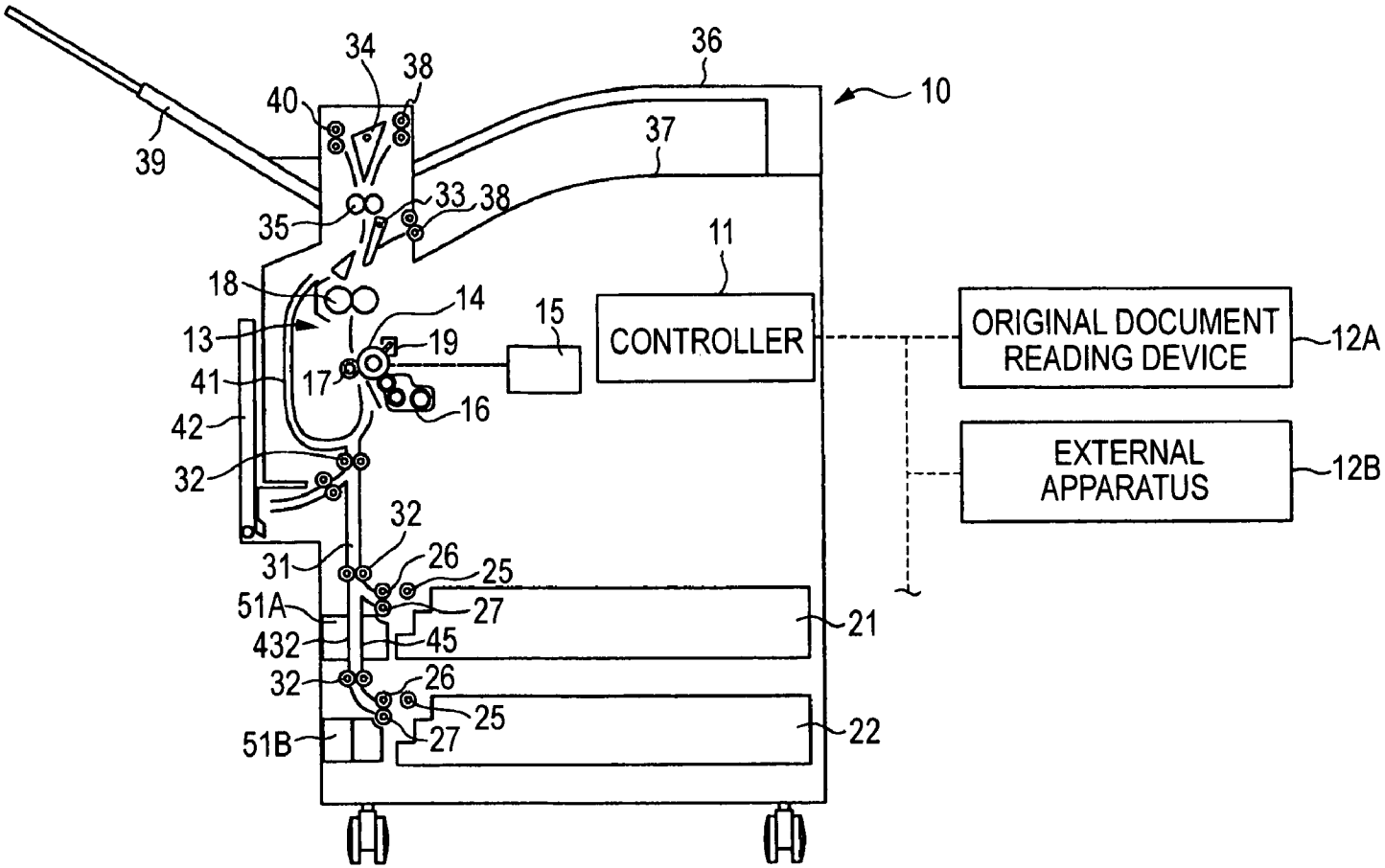
FIG. 1 is a schematic structural view showing an image forming apparatus according to an exemplary embodiment of the present invention.

Now, embodiments of the invention will be described in detail, referring to the drawings.

FIG. 1 is a schematic structural view showing an image forming apparatus according to exemplary embodiments. In FIG. 1, an interior of the image forming apparatus is shown in a state as seen from a front side (an outside).

The image forming apparatus as shown in FIG. 1 includes an image forming apparatus body (body) 10 that forms an image on a sheet, utilizing an electro-photographic system. This image forming apparatus body 10 has a controller 11 that controls the entirety of the apparatus with respect to conveyance of sheets and formation of images. An original document reading device 12A which reads an original document and outputs image data, and an external apparatus 12B such as a PC that forms the image data and outputs the image data to the outside are connected to the controller 11. When the image data are outputted from the original document reading device 12A or the external apparatus 12B to the controller 11, a toner image is formed by an image forming unit 13, using the image data. The toner image is transferred to a sheet and fixed on the sheet, and a printed image is outputted.

This image forming unit 13 includes a photo conductive drum 14 that carries the toner image, an image writing device 15 (herein after referred to as an ROS) that exposes the photo conductive drum 14, which is electrified, and a developing device 16 that develops an electrostatic latent image formed on the photo conductive drum 14 after the photo conductive drum 14 is exposed by the ROS 15. The image forming unit 13 is further provided with a transfer roller 17 that transfers the toner image that is developed by the developing device 16 and that is carried on the photo conductive drum 14, onto a sheet, a fixing device 18 that fixes the toner image transferred by the transfer roller 17 onto the sheet, and a cleaner 19 that removes and recovers the toner that remains on the photo conductive drum 14.

The image forming apparatus body 10 further includes a series of sheet conveying systems. Underneath the image forming apparatus body 10, there are incorporated sheet feeding trays (tray member) 21, 22 on which bundles of the sheets are mounted. Each of these sheet feeding trays 21, 22 is provided with a naja roller (a pickup roller, a feed out roller) 25, a feed roller 26, and a retard roller 27. The naja roller 25, the feed roller 26 and the retard roller 27 constitute a part of a feed unit.

A sheet separating unit (an air assist, a separating unit) 51A is provided corresponding to the sheet feeding tray 21, and a sheet separating unit 51B is provided corresponding to the sheet feeding tray 22. The naja rollers 25 are so constructed as to move up and down at a predetermined timing.

The series of the sheet conveying systems are constructed as described above. The sheet separating units 51A, 51B separate the sheets and feed out the sheets that are taken out one by one from the trays 21, 22, by means of the naja rollers 25, the feed rollers 26 and the retard rollers 27, toward a sheet conveying path 31, thereby to convey the sheets to conveying roller parts 32, which will be described below.

The sheet conveying path 31 is defined by a plurality of plate-like members, which are arranged so as to be opposed to both faces of the sheet that is being conveyed. In addition, an area close to the sheet feeding trays 21, 22 in the sheet conveying path 31 is formed between an internal member 432 and a conveying path forming member 45, which will be described below, because the internal member 432 and the conveying path forming member 45 are arranged so as to be opposed to each other.

Along the sheet conveying path 31, there are provided a pair of the conveying roller parts 32 near the feed rollers 26, gates 33, 34 that switches a direction of conveying the sheet at a position near a discharge part of the image forming apparatus body 10, and conveying rollers 35 that are arranged between the gates 33 and 34. Moreover, the sheet conveying path 31 is provided with discharge rollers 38 that discharges the sheet to discharge trays 36, 37 with the sheet's face down (in a state where a recording face is directed downward), and face up rollers 40 that discharges the sheet to a face up tray 39 with the sheet's face up (in a state where the recording face is directed upward).

There is further provided a sheet reversing and conveying path 41 that reverses the sheet having an image recorded on one face thereof and supplies the sheet to a transfer part (a contact part between the photo conductive drum 14 and the transfer roller 17).

Still further, there is provided, on a side face of the image forming apparatus body 10, a manual insertion tray 42 to be opened or closed that supplies such sizes and types of sheets that are not contained in the sheet feeding trays 21, 22, which are two-tiered.

An image forming process in the image forming apparatus body 10 having the above described structure will be described below.

A surface of the photo conductive drum 14 in the image forming unit 13 is electrified by an electrifier which is not shown. And thereafter, the photo conductive drum 14 is exposed to light by the ROS 15 on the basis of the image data, which is inputted, whereby an electrostatic latent image is formed. On the other hand, in the developing device 16, the toner is supplied from a toner box, which is not shown, and is agitated inside the developing device 16. The electrostatic latent image, which is formed on the photo conductive drum 14 is developed by means of, for example, a developing roller in the developing device 16, whereby a toner image is formed on the photo conductive drum 14.

According to a timing when the toner image is formed, the sheet separating units 51A, 51B is operated to separate the sheets on the sheet feeding trays 21, 22, and at the same time, the naja rollers 25, the feed rollers 26 and the retard rollers 27 are rotated, whereby the sheet of a predetermined size is taken out from the sheet feeding trays 21, 22. The sheet, which is taken out is conveyed by a plurality of the conveying roller parts 32, and forwarded to the transfer part that is formed by contact between the transfer roller 17 and the photo conductive drum 14.

The toner image, which is formed on the photo conductive drum 14 is transferred onto the sheet, which is conveyed to the transfer part. And, the toner image is fixed by heating in the fixing device 18, and thereafter, is outputted. Then, residual toner remaining on the photo conductive drum 14 after the transfer is removed from the photo conductive drum 14 by the cleaner 19, and is recovered.

FIRST EMBODIMENT

Now, a structure of a lower part of the image forming apparatus body 10 according to the first embodiment will be described.

Figure 2:
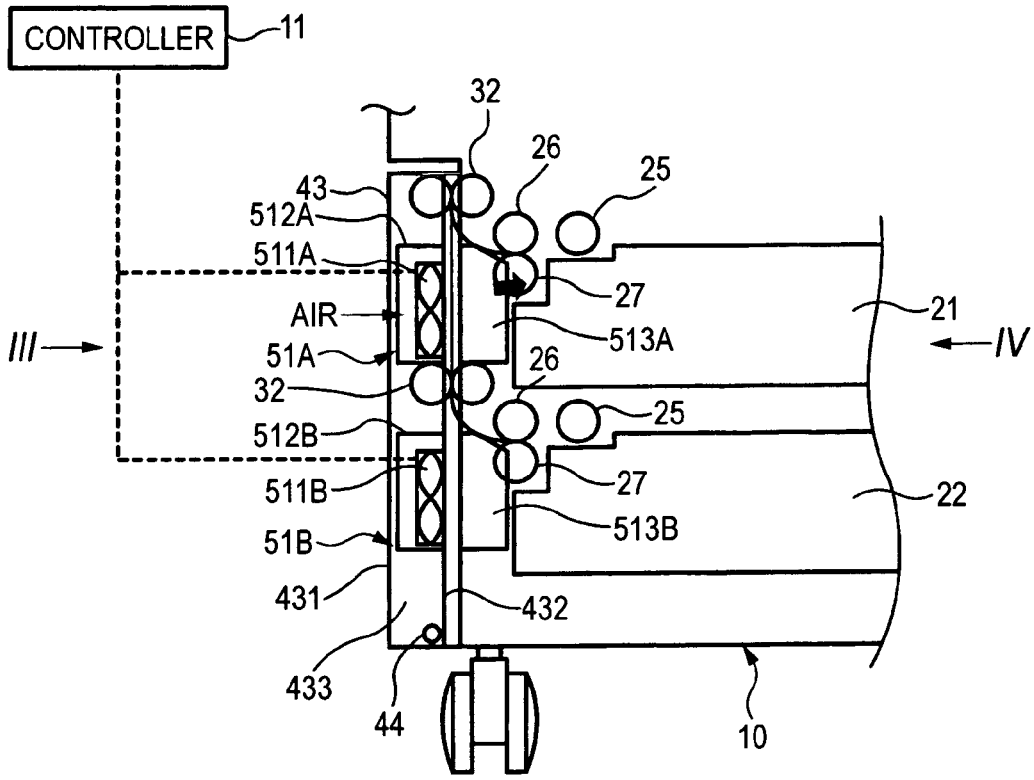
FIG. 2 is a schematic structural view showing a part of a lower part of an image forming apparatus body.
Figure 3:
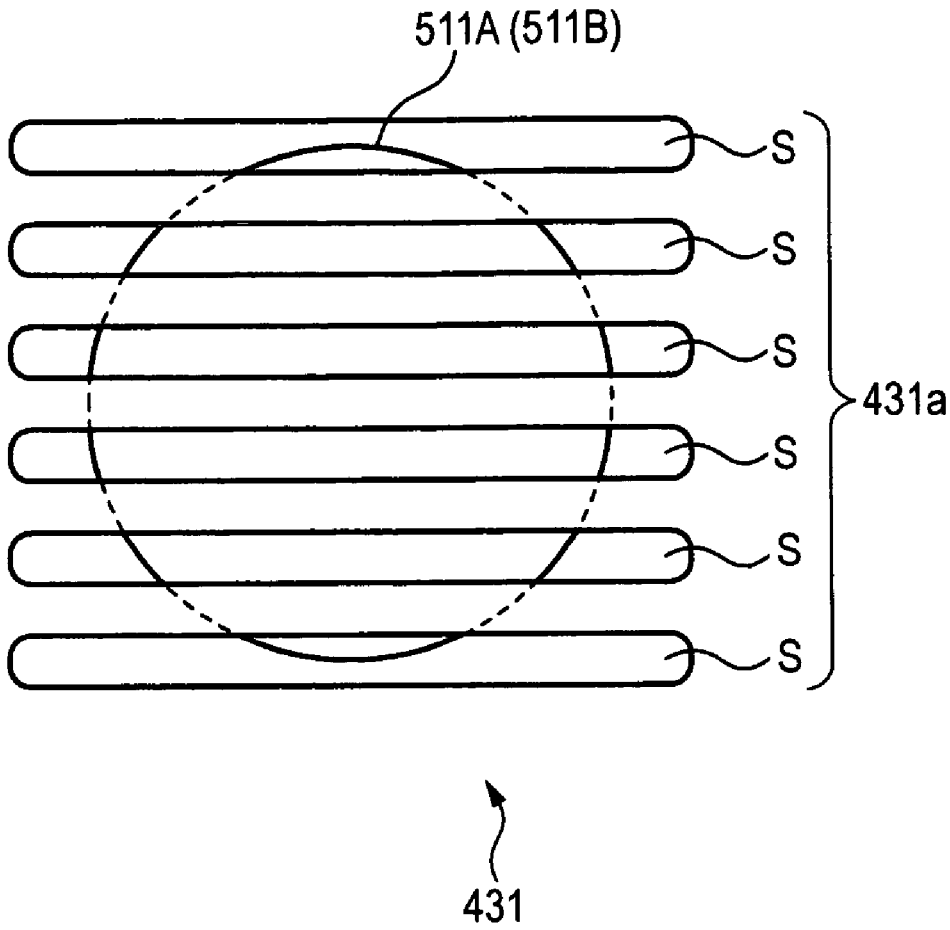
FIG. 3 is a schematic structural view partly showing an outer face of a side cover as seen in a direction of an arrow III in FIG. 2.
Figure 4:
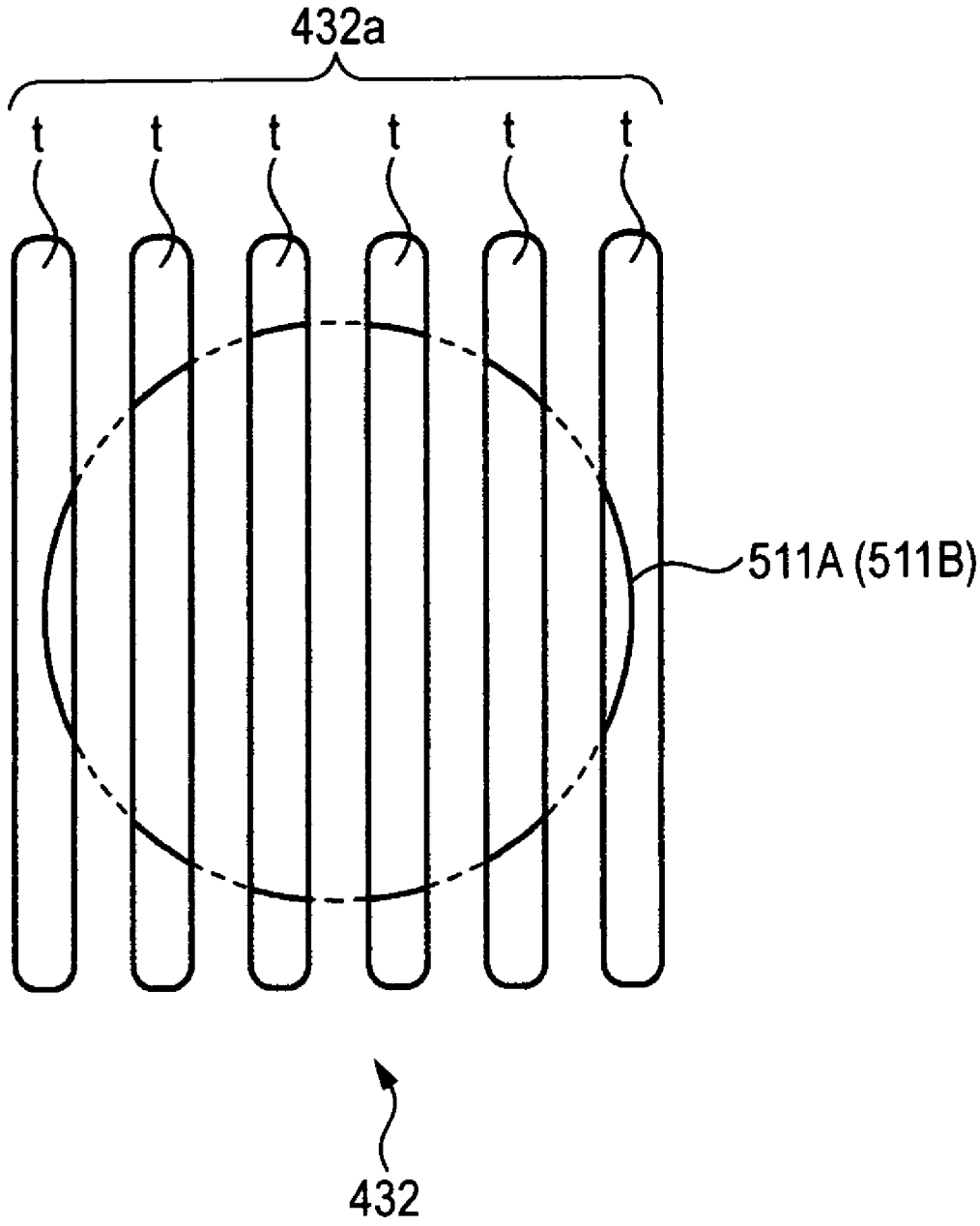
FIG. 4 is a schematic structural view partly showing an inner face of the side cover as seen in a direction of an arrow IV in FIG. 2.

FIG. 2 is a schematic structural view showing a part of the lower part of the image forming apparatus body 10. FIG. 3 is a schematic structural view partly showing an outer face of a side cover (a cover, a side face, a door member) 43 as seen in a direction of an arrow III in FIG. 2. FIG. 4 is a schematic structural view partly showing an inner face of the side cover 43 as seen in a direction of an arrow IV in FIG. 2.

As shown in FIG. 2, the side cover 43 is attached to the lower part of the image forming apparatus body 10. This side cover 43 is rotated around a support shaft 44 that is provided at a lower end of the side cover 43. Specifically, when a jam has occurred, the user can deal with jam clearance, by opening the side cover 43.

The side cover 43 has an outer face member 431 which constitutes an outer face of the image forming apparatus body 10, and an inner face member 432 which defines a part of the sheet conveying path 31 (See FIG. 1). A space 433 which is enclosed between the outer face member 431 and the inner face member 432 is formed in the side cover 43.

As shown in FIG. 3, the outer face member 431 is formed with an air intake hole (a louver, an air vent) 431*a* including a plurality of slits (openings in an elongated shape) S. Moreover, the inner face member 432 is formed with an air passing part 432*a* including a plurality of slits t, as shown in FIG. 4. The air passing part 432*a* in the inner face member 432 is formed at a position corresponding to a position of the air intake hole 431*a* in the outer face member 431.

Now, the sheet separating units 51A, 51B will be described with reference to FIG. 2. As shown in FIG. 2, the sheet separating unit 51A has a blower (an air generating source, a fan) 511A, and ducts 512A, 513A. The sheet separating unit 51B has a blower (an air generating source, a fan) 511B, and ducts 512B, 513B. The blowers 511A, 511B are controlled by the controller 11 so as to be turned on or off.

The blower 511A is located in the duct 512A. A part or entirety of a flow passage inside the sheet separating unit 51A is formed by the ducts 512A, 513A. The flow passage is formed so as to traverse the sheet separating unit 51A.

Similarly, the blower 511B is located in the duct 512B. A part or entirety of a flow passage inside the sheet separating unit 51B is formed by the ducts 512B, 513B. The flow passage is formed so as to traverse the sheet separating unit 51B.

When the blower 511A of the sheet separating unit 51A is operated, the air is taken from the air intake hole 431*a* (See FIG. 3) in the outer face member 431 into the image forming apparatus body 10, and is guided to the sheets on the paper feeding tray 21 through the ducts 512A, 513A. Similarly, when the blower 511B of the sheet separating unit 51B is operated, the air is taken from the air intake hole 431*a* in the outer face member 431 into the image forming apparatus body 10, and is guided to the sheets on the paper feeding tray 22 through the ducts 512B, 513B.

Moreover, the sheet conveying path 31 (See FIG. 1) is so provided as to pass through the sheet separating unit 51A from below to above. In other words, the sheet conveying path 31 is formed so as to pass through the sheet separating unit 51A. It can be also said that a part of the sheet conveying path 31 is formed inside the sheet separating unit 51A.

As described above, the part of the sheet conveying path 31 passing through the sheet separating unit 51A is defined by the inner face member 432 and the conveying path forming member 45. In this manner, the inner face member 432, which constitutes a part of the sheet separating unit 51A also constitutes a part of the sheet conveying path 31.

Inside the sheet separating unit 51A, the sheet conveying path 31 intersects the flow passage of the air from the blower 511A. To describe further, the flow passage of the sheet separating unit 51A, which is provided in the sheet feeding tray 21 traverses the part of the sheet conveying path 31 through which the sheet on the sheet feeding tray 22 is conveyed to the transfer part.

In case where the sheet mounted on the sheet feeding tray 22 is conveyed to the transfer part, the controller 11 controls so that only the blower 511B that is provided corresponding to the sheet feeding tray 22 is operated, but the blower 511A which is provided corresponding to the sheet feeding tray 21 is not operated. In this manner, in case where the sheet mounted on the sheet feeding tray 22 is conveyed through the sheet conveying path 31, only the blower 511B is operated, but the blower 511A is not operated. By being so constructed, the air from the blower 511A does not pass the part of the sheet conveying path 31 through which the sheet on the sheet feeding tray 22 is conveyed, so that conveyance of the sheet is not hindered.

To describe more, in case where the sheet mounted on the sheet feeding tray 21 is conveyed to the transfer part, the blower 511A is operated to separate the sheets. Although the flow passage of the air from the blower 511A passes across the sheet conveying path 31, the air from the blower 511A does not flow across the part of the sheet conveying path 31 through which the sheet mounted on the sheet feeding tray 21 is conveyed, and therefore, conveyance of the sheet is not hindered.

Figure 5:
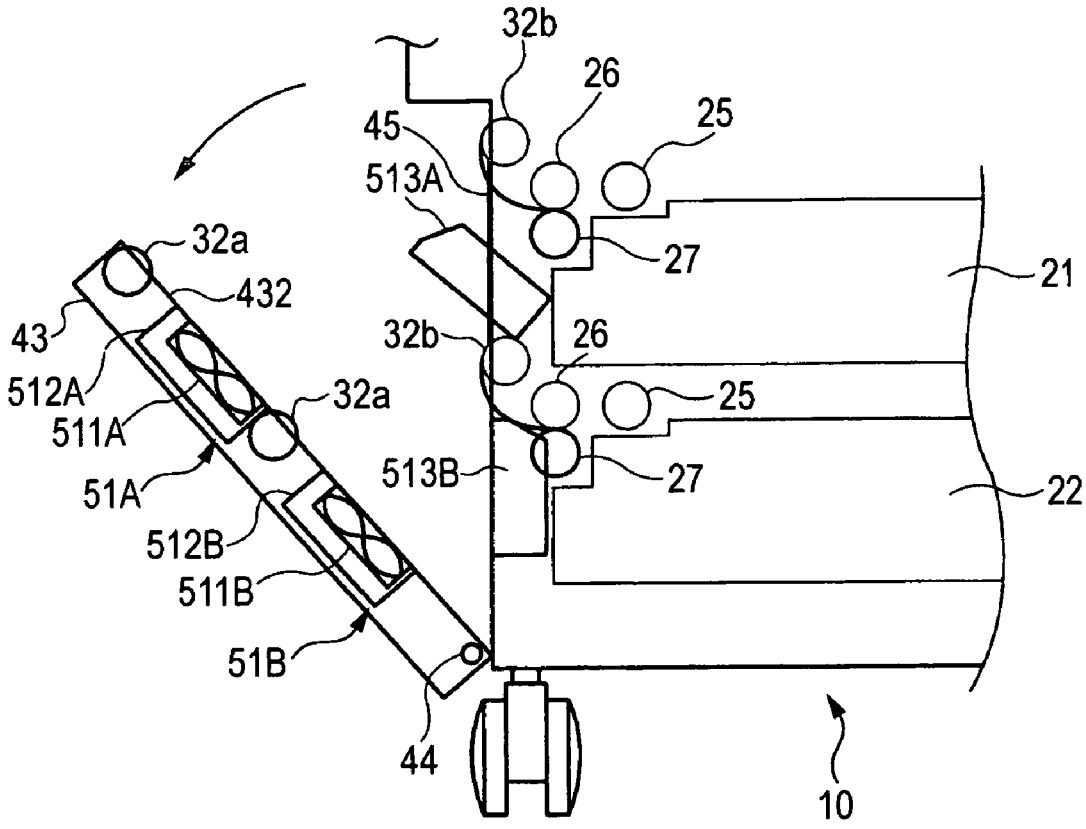
FIG. 5 is a schematic structural view showing a state where the side cover is opened in a first embodiment.

FIG. 5 is a schematic structural view showing a state where the side cover 43 is opened.

As shown in FIG. 5, in the space 433 (See FIG. 2) in the side cover 43, there are provided the blowers 511A, 511B and the ducts 512A, 512B fixed to an inner face of the side cover 43. On the other hand, the ducts 513A, 513B are attached to the image forming apparatus body 10 so as to rotate. In this manner, some parts of the sheet separating units 51A, 51B are installed on the side cover 43, while the remaining parts are installed on the image forming apparatus body 10.

Moreover, out of a pair of the conveying roller parts 32 (see FIG. 2), one conveying roller 32*a* is attached to the side cover 43, and the other conveying roller 32*b* is attached to the image forming apparatus body 10.

Further, the inner face member 432, which is adapted to form a part of the sheet conveying path 31 is attached to the side cover 43, as described above. On the other hand, the conveying path forming member 45 which constitutes a part of the sheet conveying path 31 is attached to the image forming apparatus body 10.

As described above, those members constituting the sheet separating units 51A, 51B are distributed to the side cover 43 and the image forming apparatus body 10. In the same manner, those members constituting a pair of the conveying roller parts 32 are also distributed to the side cover 43 and the image forming apparatus body 10. Similarly, those members constituting the sheet conveying path 31 are distributed to the side cover 43 and the image forming apparatus body 10.

When the side cover 43 in a closed state is opened by rotating the side cover 43 around the support shaft 44, the blower 511A and the duct 512A of the sheet separating unit 51A is separated from the duct 513A, and at the same time, the blower 511B and the duct 512B of the sheet separating unit 51B is separated from the duct 513B. In short, an interior of the image forming apparatus body 10 is disclosed, only by opening the side cover 43.

To describe further, when the side cover 43 is opened, the conveying rollers 32*a*, 32*b* which constitute a pair of the conveying roller parts 32 is separated from each other, and the inner face member 432 and the conveying path forming member 45 which constitute the sheet conveying path 31 is also separated from each other. In short, when the side cover 43 is opened, those members which constitute the sheet conveying path 31 are separated from the image forming apparatus body 10.

Figure 6B:
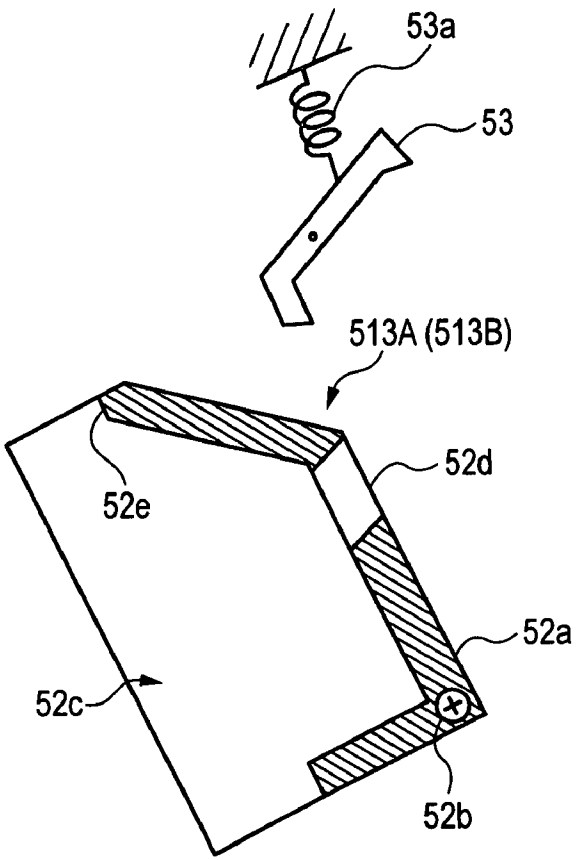
FIGS. 6A and 6B are vertical sectional views showing a structure of a duct and a locking structure of the duct, respectively.
Figure 6A:
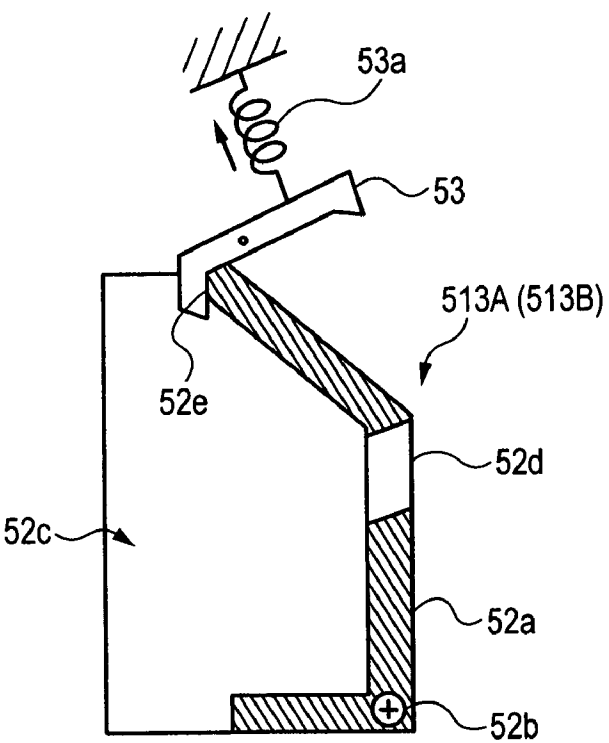

FIGS. 6A and 6B are vertical sectional views showing a structure of the duct 513A, 513B and a locking structure for the duct 513A, 513B, in which FIG. 6A shows a case where the duct 513A, 513B is in a fixed state, and FIG. 6B shows a case where the duct 513A, 513B is in a retracted state.

As shown in FIGS. 6A and 6B, the duct 513A, 513B includes a duct body 52*a*, a rotation shaft 52*b* that holds the duct body 52*a* so as to rotate with respect to the image forming apparatus body 10 (See FIG. 1), an internal space 52*c* that is formed in the duct body 52*a*, a blow-out hole 52*d* that is formed in the duct body 52*a* to communicate with the internal space 52*c*, and an engaging part 52*e* adapted to be engaged with a lever 53 which is rotatably held by the image forming apparatus body 10.

The rotation shaft 52*b* is arranged in a lower part of the duct body 52*a* at a position offset (an eccentric position) from the center of gravity of the duct body 52*a*. For this reason, in a state where the engaging part 52*e* is not engaged with the lever 53, the duct body 52*a* rotates around the rotation shaft 52*b* so as to be inclined outward.

As shown in FIG. 6A, posture of the duct body 52*a* can be maintained so as not to rotate, by the engagement of the lever 53 with the engaging part 52*e*. This lever 53 is urged by a tensile spring 53*a* so as to be pressed against the engaging part 52*e*. When the user rotates the lever 53 against a force of the tensile spring 53*a*, the lever 53 is separated from the engaging part 52*e*, as shown in FIG. 6B, and the duct body 52*a* is inclined by its own weight around the rotation shaft 52*b*. In this manner, the members installed in the image forming apparatus body 10 out of those members constituting the sheet separating units 51A, 51B are so constructed as to rotate with respect to the image forming apparatus body 10. In other words, the ducts 513A, 513B are so constructed as to move apart from the feed units.

SECOND EMBODIMENT

Then, the second embodiment will be described. It is to be noted that since some structure is common both in the first embodiment and in the second embodiment, the same members are denoted with the same reference numerals. Those matters different from the first embodiment will be mainly described below.

Figure 7:
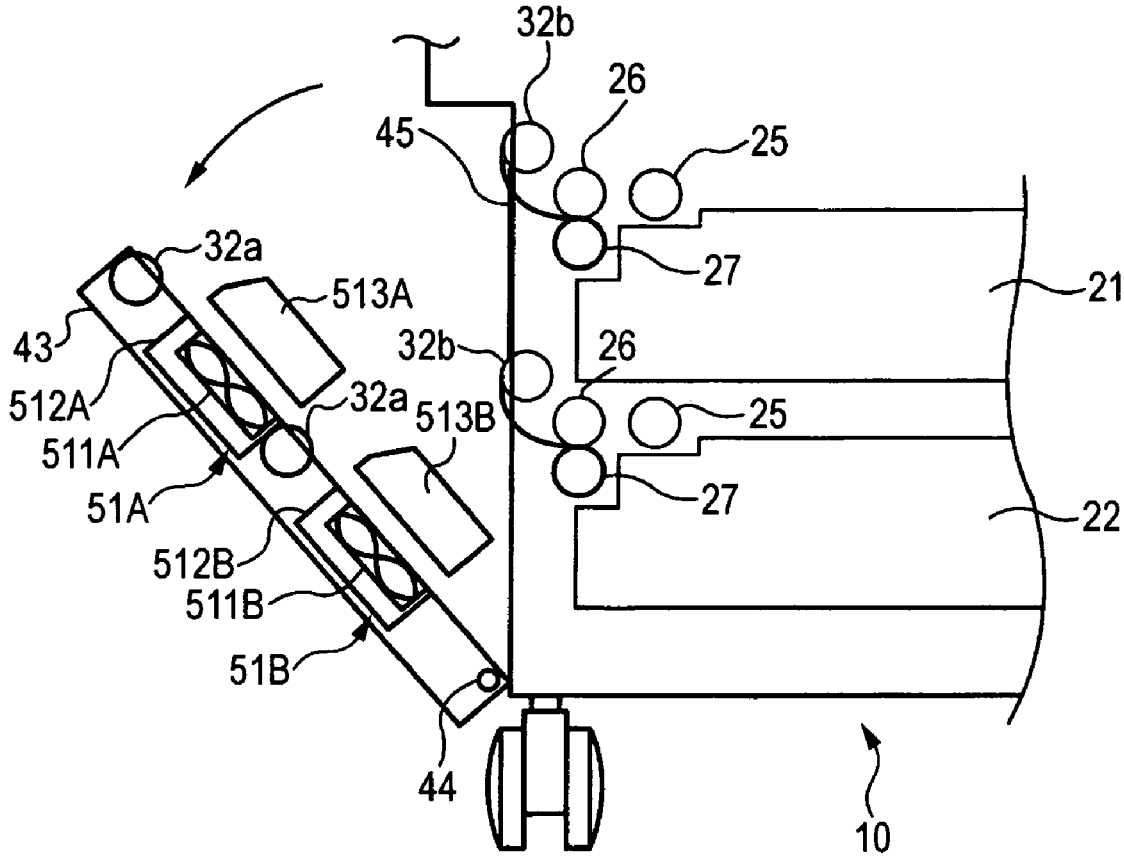
FIG. 7 is a schematic structural view showing a state where the side cover is opened in a second embodiment.

FIG. 7 is a schematic structural view showing a state where the side cover 43 is opened in the second embodiment, which corresponds to FIG. 5 in the first embodiment.

As shown in FIG. 7, all the constituent members of the sheet separating units 51A, 51B are attached to the side cover 43. Specifically, not only the blowers 511A, 511B and the ducts 512A, 512B, but also the ducts 513A, 513B are attached by fixing to the side face 43. For this reason, the user can get access to those places where jams are likely to occur, only by opening the side cover 43.

THIRD EMBODIMENT

Then, the third embodiment will be described. It is to be noted that because some structure is common both in the first embodiment and in the third embodiment, the same members are denoted with the same reference numerals. Those matters different from the first embodiment will be mainly described below.

Figure 8:
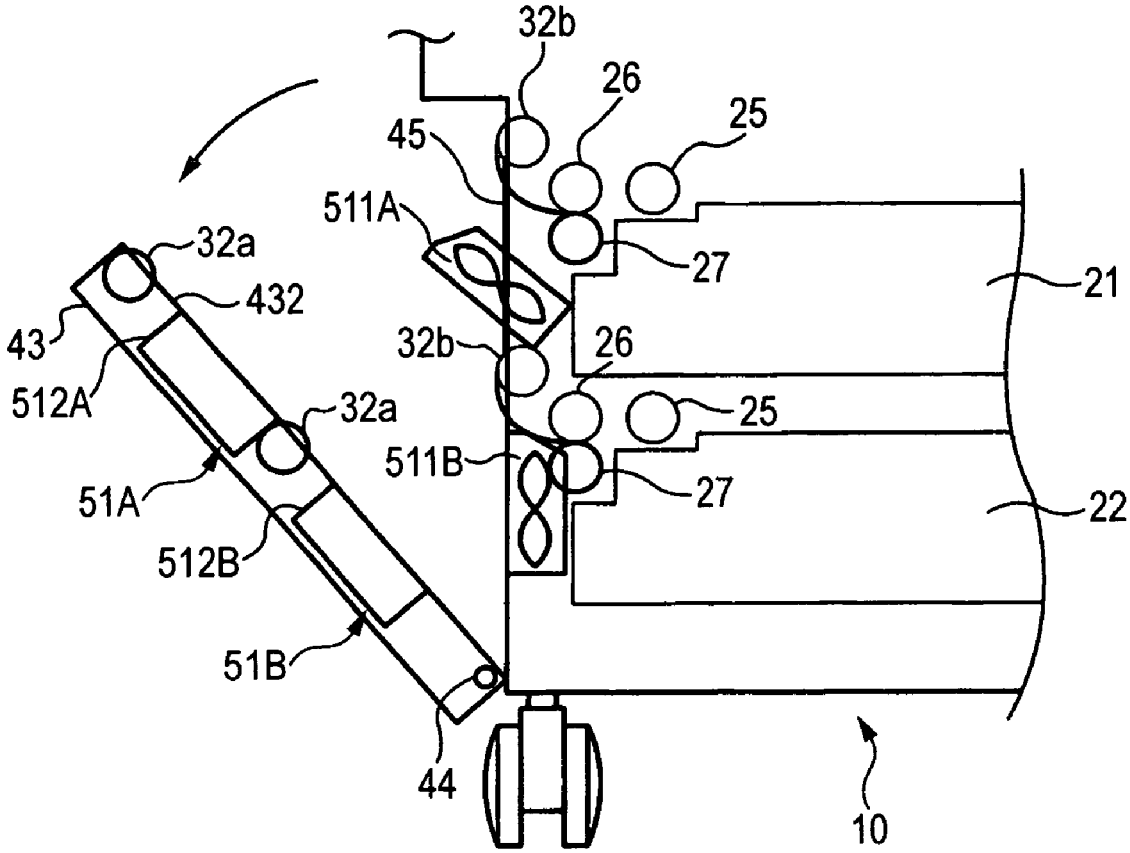
FIG. 8 is a schematic structural view showing a state where the side cover is opened in a third embodiment.

FIG. 8 is a schematic structural view showing a state where the side cover 43 is opened in the third embodiment, which corresponds to FIG. 5 in the first embodiment.

As shown in FIG. 8, some of the constituent members of the sheet separating units 51A, 51B are attached to the side cover 43. Specifically, the ducts 512A, 512B are attached by fixing to the side cover 43. On the other hand, the blowers 511A, 511B are rotatably attached to the image forming apparatus body 10.

The foregoing description of the embodiments of the present invention have been provided for the purpose of illustration and description. It is not intended to be exhaustive or limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding apparatus comprising:

a body;

a tray unit on which a plurality of sheets are mounted, the tray unit being provided in the body;

a separating unit that separates the plurality of sheets by blowing air toward the plurality of sheets mounted on the tray unit; and a cover that is attached to the body at a position near the tray unit so as to be capable of opening and closing, the cover being provided with at least a part of the separating unit.

2. The sheet feeding apparatus according to claim 1, wherein the separating unit includes an air generating source, which is provided on the cover.

3. The sheet feeding apparatus according to claim 1, wherein the separating unit includes an air generating source, which is provided on the body.

4. A sheet feeding apparatus according to claim 1, wherein a part of the separating unit is provided on the cover, and a remaining part of the separating unit is provided in the body, and wherein at least a part of the remaining part of the separating unit is movable with respect to the body.

5. The sheet feeding apparatus according to claim 1, wherein the cover is formed with an air vent, which is located near the separating unit.

6. The sheet feeding apparatus according to claim 1, further comprising a conveying mechanism that conveys the sheets mounted on the tray unit along a conveying path, the conveying path being formed so as to pass through the separating unit.

7. A sheet feeding apparatus comprising:

a body that contains a plurality of sheets;

a separating unit that separates the plurality of sheets by blowing air toward the plurality of sheets contained in the body;

a cover that is attached to the body at a position near the body so as to be capable of opening and closing, the cover being provided with at least a part of the separating unit; and a conveying mechanism that conveys each of the plurality of sheets being separated by the separating unit along a conveying path.

8. The sheet feeding apparatus according to claim 7, wherein the conveying path is formed so as to pass through the separating unit.

9. The sheet feeding apparatus according to claim 7, further comprising a plurality of members that form the conveying path, the members being provided respectively in the body and in the cover.

10. The sheet feeding apparatus according to claim 7, wherein a part of the separating unit forms a part of the conveying path.

11. The sheet feeding apparatus according to claim 7, further comprising a pair of conveying rollers that convey sheets along the conveying path to a downstream side with respect to a sheet conveying direction, wherein one of the pair of conveying rollers is provided with the body, and another of the pair of conveying rollers is provided with the cover.

12. The sheet feeding apparatus according to claim 7, wherein the cover is capable of rotating around one end of the cover.

13. An image forming apparatus comprising:

a body;

a plurality of tray units on which a plurality of sheets are mounted, the tray units being arranged in the body in a vertical direction;

a plurality of separating units each of which is provided respectively for each of the tray units, each of the separating units including a flow passage for air blowing the sheets mounted on each of the tray units to separate the sheets;

a plurality of feed units each of which feeds out one of the sheets on each of the tray units, each of the feed units being provided respectively for each of the tray units;

a conveying mechanism that conveys the sheet fed out from the feed units along a conveying path;

an image forming unit that forms a toner image and transfers the toner image to the sheet conveyed by the conveying mechanism, the image forming unit being provided in the body; and a door member in which at least a part of the separating units is provided, the door member being provided so that when the door member is open, an interior of the body near the tray units is capable of being disclosed;

wherein when the door member is open, at least a part of the conveying path is separated from the body.

14. The image forming apparatus according to claim 13, wherein a part of the conveying path is in the separating units.

15. The image forming apparatus according to claim 13, wherein each of the flow passages intersect the conveying path.

16. The image forming apparatus according to claim 13, wherein the flow passage provided on one of the tray units traverses the conveying path through which the sheet mounted on another of the tray units is conveyed to the image forming unit.

17. The image forming apparatus according to claim 13, wherein the flow passage provided on one of the tray units traverses the conveying path through which the sheet mounted on another of the tray units adjacent to the one of the tray units is conveyed to the image forming unit.

18. The image forming apparatus according to claim 17, further comprising a controller that controls the air to flow through the flow passage included in one of the separating units, only when the sheet is separated by the one of the separating units.

19. The image forming apparatus according to claim 13, wherein each of the separating units includes a duct, which forms a part of the flow passages, and wherein each of the ducts is movable in a direction apart from the feed units.

20. The image forming apparatus according to claim 13, wherein the door member is formed with an air vent that takes air into each of the flow passages.

* * * * *